US006274855B1

(12) United States Patent
Tatematsu et al.

(10) Patent No.: US 6,274,855 B1
(45) **Date of Patent: *Aug. 14, 2001**

(54) HEATING RESISTOR FOR CERAMIC HEATERS, CERAMIC HEATERS AND METHOD OF MANUFACTURING CERAMIC HEATERS

(75) Inventors: Kazuho Tatematsu, Kasugai; Shindo Watanabe, Nagoya, both of (JP)

(73) Assignee: NGK Spark Plug Co., Ltd., Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/441,207

(22) Filed: Nov. 16, 1999

(30) Foreign Application Priority Data

Nov. 17, 1998 (JP) ..... 10-327317
Nov. 17, 1998 (JP) ..... 10-327318

(51) Int. Cl.[7] ..... H05B 3/10

(52) U.S. Cl. ..... 219/548; 219/553; 219/505; 29/611

(58) Field of Search ..... 219/270, 504, 219/505, 538, 542, 544, 546, 548, 552, 553; 338/22 R, 283–285, 226; 29/611; 501/97.1, 97.2, 97.3, 97.4

(56) References Cited

U.S. PATENT DOCUMENTS

| | | | | |
|---|---|---|---|---|
| 4,652,727 | * | 3/1987 | Hoshizaki et al. | 219/541 |
| 4,697,165 | * | 9/1987 | Ishiguro et al. | 338/34 |
| 4,874,923 | * | 10/1989 | Hatanaka et al. | 219/270 |
| 5,086,210 | | 2/1992 | Nunogaki et al. | 219/270 |
| 5,883,360 | * | 3/1999 | Tatematsu et al. | 219/270 |
| 5,948,306 | * | 9/1999 | Konishi et al. | 219/548 |
| 6,013,898 | * | 1/2000 | Mizuno et al. | 219/270 |
| 6,049,065 | * | 4/2000 | Konishi | 219/270 |

FOREIGN PATENT DOCUMENTS

| | | |
|---|---|---|
| 60-28193 | 2/1985 | (JP) . |
| 1-317170 | 12/1989 | (JP) . |

* cited by examiner

*Primary Examiner*—Tu Ba Hoang
(74) *Attorney, Agent, or Firm*—Morgan, Lewis & Bockius LLP

(57) ABSTRACT

A ceramic heater of required heating properties is made available in that adjusting elements made solid in an electric conductive element are added other than electric conductive elements of an heating resistor in a ceramic heater. Accordingly, resistance temperature coefficient is changed, not largely changing other properties of heating materials. The heating resistor may be used to a double frame ceramic heater, whereby deviations of baking conditions may be made little to heighten adherence and avoid breakage at grain boundaries

7 Claims, 1 Drawing Sheet

HEATING RESISTOR FOR CERAMIC HEATERS, CERAMIC HEATERS AND METHOD OF MANUFACTURING CERAMIC HEATERS

BACKGROUND OF THE INVENTION

1. Field of the Invention

The present invention relates to a heating resistor for ceramic heaters, ceramic heaters and a method of manufacturing ceramic heaters, and particularly to a heating resistor for ceramic heaters used for heating glow plugs of a diesel engine or others, ceramic heaters employing the same, and a method of manufacturing the ceramic heaters.

2. Description of the Related Art

There have conventionally been known instruments which employ heating resistors for ceramic heaters provided with various kinds of rising temperature properties (e.g., resistance temperature coefficient) used at high temperatures of 1000° C. or more such as glow plugs, including metals of W, Mo, Ti, Zr and Hf, or their carbides, nitrides and suicides.

However, recently in response to applications, rapidly heightening temperature properties or heating properties at constant temperatures are required, and many applications do not meet the heightening temperature requirements. Since heightening temperature properties are decided by the heating resistor, it was very often difficult to manufacture ceramic heaters having optional heightening temperature properties. In addition, these resistant materials were, when baking, insufficient in sintering, and caused exceptional grain growth and thereby decreased strength.

SUMMARY OF THE INVENTION

It is an object of the invention to provide a heating resistor for ceramic heaters capable of optionally adjusting the resistance temperature coefficient of the heating resistor and having excellent anti-bending strength and electric conductive durability, as well as a ceramic heater employing the heating resistor, and a method of manufacturing the ceramic heater.

DETAILED DESCRIPTION OF THE INVENTION

Figure 1:
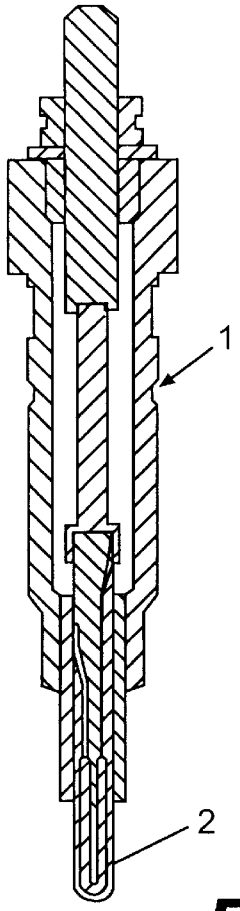
FIG. 1 is a cross sectional view for explaining a glow plug using the ceramic heater of the present invention.

The present invention will be described as follows in detail.

A heating resistor for ceramic heaters according to a first embodiment of the present invention contains an electrically conductive element composed of a material including at least one of a suicide, carbide, and nitride of one or more materials selected from W, Ta, Nb, Ti, Mo, Zr, Hf, V and Cr and an adjusting element combined with materials of the electric conductive element for changing resistance temperature coefficient of the heating resistor of the ceramic heater.

A ceramic heater of the first embodiment has a ceramic base and the heating resistor for the ceramic heater of the first embodiment to be disposed in the ceramic base.

Further, the ceramic heater of the first embodiment can have a compound member including a heating part composed of the heating resistor for the ceramic heater and a control resistor formed in at least one side of the heating part.

For the electrically conductive element, it is possible to select materials including one or more of a silicide, carbide, and nitride of one or more metallic elements selected from W, Ta, Nb, Ti, Mo, Zr, Hf, V and Cr. It is preferable that the coefficient of expansion of the electrically conductive element is closer to other ceramic elements (silicon nitride) contained in the heating resistor, or to ceramic basic materials, and for example, WC may be used. Since the ceramic sensor of the present invention is produced by baking at high temperature, it is better to use materials with high melting points. For example, materials such as WC, TiN, or $MoSi_2$ may be used.

If the adjusting clement is sufficiently combined with materials of the electrically conductive element, the resistance temperature coefficient of the heating resistor for the ceramic heater (called briefly as "heating resistor" hereafter) may be changed, not defining any special limitation.

Preferably, this adjusting element is a metallic element of one or more metallic elements selected from W, Ta, Nb, Ti, Mo, Zr, Hf, V and Cr. Among these metallic elements, V or Cr is desirous, and the metallic elements composing the conductive element are excepted.

The ceramic element contained in the heating resistor for the ceramic heater or the ceramic element composing the ceramic base are variously selected in view of purposes, and ordinarily the ceramics of silicon nitride quality are used.

In this silicon nitride quality, elements containing mainly silicon nitride are broadly included, and the main element is not limited to silicon nitride.

It is sufficient that the control resistor has properties different from the heating part composed of the heating resistor (rising temperature property or electric conductive property), for example, differing kinds or containing rates in the electric conductive element and/or the adjusting element. In particular, as good examples, such control resistors may be enumerated, in which a conductive element composing the heating part and another conductive element composing the control resistor are the same kind, and the control resistor has different containing rate in the adjusting element. By thus changing the containing rate or only grain diameter of the adjusting element, a double frame ceramic heater may be produced which is sufficient with small differences in material elements of the heating part and the control resistor, and is almost the same in the baking conditions.

The method of manufacturing the ceramic heater according to the first embodiment includes the steps of mixing raw materials for an electrically conductive clement composed of at least one of a silicide, carbide, and nitride of one or more metallic elements selected from W, Ta, Nb, Ti, Mo, Zr, Hf, V and Cr and raw materials for an adjusting element to be made solid as the adjusting element after baking, molding the mixture, burying this molded body in ceramic powdered materials, and baking it. For carrying out this baking, the ceramic powdered materials buried therein with the molded body are molded as one body to be a ceramic molded body, and this molded body is baked.

The raw materials for the electrically conductive element to be used to this method are one or more of a silicide, carbide and nitride of one or more metallic elements selected from W, Ta, Nb, Ti, Mo, Zr, Hf V and Cr. Among them, in particular, WC powders, TiN powders or $MoSi_2$, powders are preferable.

The raw material for the adjusting element to be used in the inventive method is sufficient with raw materials adjusting, the resistance temperature coefficient in the heating resistor for the ceramic after sintering. As good examples, such raw materials are one or more of a carbide, oxide, nitride and silicide of metallic elements of one or more of metallic elements different from metallic elements contained in the electrically conductive element among W, V, Ti, Mo and Cr. However, the materials containing metallic elements composing the heating resistor are excepted. For example, boride ($W_2B_5$, $TiBr_2$, MoB, $Mo_2B$, $MoB_2$, or CrB) may be selected Kinds of the ceramic powdered materials buried therein with desired molded bodies may be selected in view of purposes, and ordinarily ceramic powdered materials of silicon nitride quality are employed. Substances of silicon nitride being main are broadly contained in this silicon nitride quality, not limiting to silicon nitride.

Shapes of these raw materials are not specially limited and may be merely powdered, granulated or pulverized, and grain diameters are not specially Limited.

In the heating resistor for ceramic heaters, parts or all of the adjusting element are made solid in crystal grains of the conductive element. When the raw materials for the adjusting element are much mixed and baked, the amount of the adjusting element contained in the ceramic heaters and accordingly the amount of the adjusting element made solid are increased. Following this increase, the resistance temperature coefficients are small (see Table 2). Thus, if the adjusting element is contained in the conductive element at an optional rate, the resistance temperature coefficient of the heating resistor can be optionally determined.

The adjusting element is not only made solid in the crystal grains of the conductive element, but also partially segregated as various compounds in grain boundary phases. It is assumed that the adjusting element segregated in the grain boundary gives influences to changes of the resistance temperature coefficient of the heating element, but large influences to an extent of being made solid will not be generated.

As the adjusting element can bring about large effects at a small amount of addition, it is assumed that the addition of the adjusting element gives little bad influences to properties other than the resistance temperature coefficient of the heating resistor (for example, strength, durability, thermal shock resistance and adherence).

Reference will be made in detail to the ceramic heater and the method of manufacturing the same of the first embodiment.

(1) Production of the Ceramic Heaters

Explanation will be made to the method of manufacturing the ceramic heater employing the heating resistor for the ceramic heater.

The predetermined raw materials for the conductive element, the insulation raw material ($Si_3N_4$ powder), the sintering assistant and the raw materials for the adjusting element of a predetermined amount were added (the volume ratio of the raw materials for the conductive element and the raw materials for insulation was 20:80, and concerning the adjusting element, see Table 1). They were wet-mixed for 72 hours. Then, the mixed powders were produced by drying. The powders and molding assistant binder were thrown into a kneading machine and mixed for 4 hours.

Then, the kneaded matter was cut, and thrown into an injection molding machine to turn out U-shaped unsintered heater body provided at both sides with tungsten-made lead wires.

The sintering assistant powders (about 6%) was mixed into $Si_3N_4$ powders, wet-mixed for 40 hours, and granulated by a spray dryer. Then, the unsintered heater main body was buried in the granulated product charged into a predetermined mold and pressed all over them to turn out unsintered ceramic heaters. Then, the unsintered ceramic heater was temporarily baked at 600° C. for about 2 hours to remove the binder and hot-press-baked at 1800° C., 300 kgf/cm$^2$ and for 60 minutes to turn out ceramic heaters.

(2) Composition of the Ceramic Heaters

Figure 2:
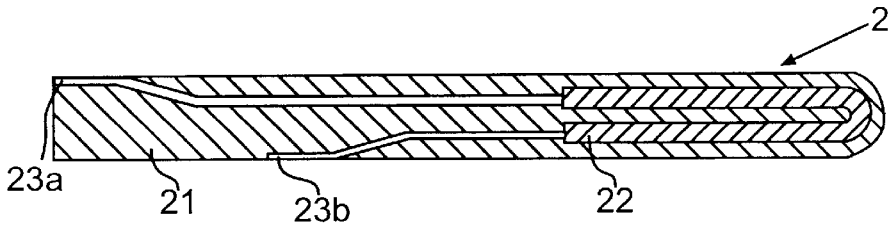
FIG. 2 is a cross sectional view for explaining the ceramic heater of the present invention.

A ceramic heater 2 which is manufactured by the manufacturing method of this embodiment is shown in FIG. 2. A glow plug 1 employing the ceramic heater 2 is shown in FIG. 1.

The glow plug 1 is furnished with the ceramic heater 2 at a front end being a heating position, and the ceramic heater comprises the base 21, heating resistor 22 and electric supplies 23*a*, 23*b*.

The base 21 is the ceramics of main $Si_3N_4$ for protecting the heating resistor 22 and the electric supplies 23*a*, 23*b* to be buried. The heating resistor 22 is a U-shaped bar disposed in the base 21, and further contains the adjusting element for adjusting the conductive element other than the conductive element as the main ceramics.

Each one ends of the electric supplies 23*a*, 23*b* are, as shown in FIG. 2, disposed at the surface of the base 21, and the other ends are connected to each ends of the heating resistor 22, so that the power supplied outside of the ceramic heater 2 can be supplied to the heating resistor 22 in the base 21.

(3) Evaluation of Resistance Temperature Coefficient of the Ceramic Heater

With respect to the glow plug of the above mentioned structure as shown in FIG. 1, variously changing the conductive elements (raw materials) and the raw materials for the adjusting element, the resistance temperature coefficients were studied and results are shown in Table 1. The mixing percent of the raw materials for the adjusting elements was the mixing amount when both raw materials for the conductive elements and the adjusting elements were 100 weight parts in total, referring to as "wt %" hereafter. The containing rate of the adjusting elements contained in the sintered body, i.e., the heating resistor is substantially the same as the percents in Table 1.

The average grain diameters of the raw materials for the conductive elements and the adjusting elements are as follows. WC: 1 μm, TiN: 1 μm, VC: 1 μm, $V_2O_5$: 2 μm, VN: 3 μm, $Cr_3C_2$: 2 μm, $Cr_2O_3$: 1 μm, and CrN: 3 μm.

The resistance temperature coefficients of the ceramic heater were ratios of the resistant values at 25° C. and the resistant values at 1000° C. The resistant values were measured as follows. Namely, conditions were prepared in that the electric conduction was kept for 3 minutes or more under a state where the voltage was adjusted such that a highest temperature portion of the ceramic heater would be 1000° C., and the resistant value at 1000° C. was calculated from the voltage and the current value when being stable. The resistant value at 25° C. was obtained by an ohmmeter.

TABLE 1

| Conductive Elements | Raw material for adjusting element | Percentage wt % | Resistance temperature coefficient R(1000° C.)/R(25° C.) |
|---|---|---|---|
| WC | Nothing | 0 | 3.45 |
| | VC | 0.2 | 3.39 |
| | | 0.5 | 3.31 |
| | | 1 | 3.16 |
| | $V_2O_5$ | 0.5 | 3.35 |
| | VN | 0.5 | 3.31 |
| | $Cr_3C_2$ | 0.5 | 3.37 |
| | $Cr_2O_3$ | 0.5 | 3.38 |
| | CrN | 0.5 | 3.37 |
| TiN | Nothing | 0 | 4.50 |
| | VN | 0.5 | 4.00 |

As shown in Table 1, it is seen that when the conductive elements are the same WC, the resistance temperature coefficients can be varied over wide ranges from the coefficient of 3.45 without containing the adjusting element to the coefficient of 3.16 with containing VC 1 wt % (that is, the adjusting element V is 1 wt %). Since the addition amount at this time is low as 1 wt % at maximum, large influences are not given to the properties of the heating resistor. It is seen that as the containing amount (addition amount) is increased, the resistance temperature coefficient is decreased in reverse proportion.

As seen from the examples using Cr elements (raw materials for adjusting elements: $Cr_{32}$, $Cr_2O_3$, CrN) for the adjusting element and from examples using V elements (raw materials for adjusting elements VC, $V_2O_5$, VN), if the amount of the metallic element to tie added and the amount of the metallic element contained in the additive are the same (0.5 wt %), the resistance temperature coefficients will be almost the same.

When TiN is used to the conductive element (raw material), comparing with the conductive element of WC, it is seen that the resistance temperature coefficient is large, and though the adjusting elements are contained at the same rate (0.5 wt %), the resistance temperature coefficients are largely changed from 4.50 to 4.00.

Not limiting to the examples, the elements can be varied within the inventive ranges in response to purposes or uses. That is, as the electric conductive element and the adjusting element materials, not only the metallic elements shown in Table 1 but also other metallic elements may be used. Further, as the raw materials for the adjusting element, a metallic simple substance can be used other than the ceramic compounds of carbides.

Figure 3:
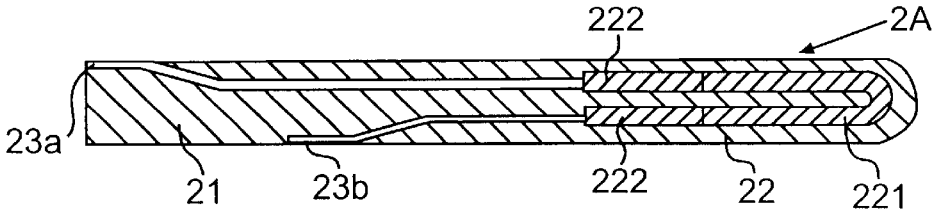
FIG. 3 is a cross sectional view for explaining the double frame ceramic heater of the present invention.

In a case of a double frame ceramic heater 2A as shown in FIG. 3 in which the heating resistor 22 is divided into a heating part 221 and a control resistor 222, and if resistance temperature property of the heating part 221 is made large and the control resistor 222 is made low resistance, it is possible to produce such a ceramic heater of low consumption power where heating is lowered in the vicinity of requiring no heating and the heating is generated concentrically at the front end requiring the heating. It is possible to produce a further ceramic heater that the heating part 221 and the control resistor 222 are exchanged to enlarge a heating range (heating volume).

If using the heating resistor for such a double frame ceramic heater 2A, the electric conductive element may be used in common, and if changing respectively the content ratios of the adjusting elements, different resistance temperature coefficient may be available in the heating part 221 and the control resistor 222.

As this example, such a double frame ceramic heater 2A may be enumerated, in which WC is used to the conductive elements of the heating part 221 and the control resister 222, and the adjusting element is not contained in the heating part 221 and VC of 0.5 wt % is contained in the control resistor 222. In the double frame ceramic heater 2A, difference of 0.14 occurs in the resistance temperature coefficient, and when it is at high temperature, since the heating part 221 has higher resistance than that of the control resistor 222, the heating part 221 mainly issues heating.

If the electric conductive element is used in common between the heating part 221 and the control resistor 222 and the only containing ratio of the adjusting elements is changed, deviations of the respective baking conditions may be decreased. In addition, the same kind of the raw materials for the electric conductivity and for the adjusting material is used to form as one body, so that the adherence can be heightened and breakage at grain boundary can be avoided.

According to the heating resistor for ceramic heaters and the ceramic heater of the first embodiment, the ceramic heater of the desired heating properties may be produced, not largely changing other properties of the heating resistor but changing the resistance temperature coefficient.

In the double frame ceramic heater, deviations of the baking conditions may be made little, and it is possible to increase the adherence and prevent breakage at grain boundary. further, the useful ceramic heater can be made easily and securely.

A heating resistor for ceramic heaters according to a second embodiment composed of the sintered body, contains an electric conductive element composed of at least one of a carbide, nitride and silicide of one or more metallic elements selected from W, Ta, Nb, Ti, Mo, Zr, Hf, V and Cr and an adjusting element made partially solid in the electrically conductive element for changing resistance temperature coefficient of the heating resistor, wherein when an total of the electrically conductive element and the adjusting element is 100 wt %, the adjusting element is 0.1 to 0.5 wt %, and the average diameter of crystal grains of the electrically conductive element composing the heating resistor is 11 $\mu$m or less. Preferably, the average diameter of crystal grains of the electrically conductive element is 0.5 $\mu$m or more.

A ceramic heater according to the second embodiment has a ceramic base and the heating resistor for the ceramic heater of the second embodiment.

For the electrically conductive element, it is possible to select one or more of a suicide, carbide and nitride of one or more metallic elements selected from W, Ta, Nb, Ti, Mo, Zr, Hf, V and Cr. It is preferable that the coefficient of expansion of the electrically conductive element is closer to other ceramic elements (silicon nitride quality) contained in the heating resistor, or to ceramic basic materials, and for example, WC may be used.

An average grain diameter of crystal grains of the electrically conductive element in the sintered body is 11 $\mu$or less (especially preferably 10 $\mu$m or less, and preferably 9.5 $\mu$m). Because, if exceeding 11 $\mu$m, it is difficult to get enough anti-bending strength, and electric conduction durability is deteriorated. By changing the grain diameter, the resistance temperature coefficient may be appropriately changed.

The adjusting clement is sufficient with such metallic elements in which if at least its part is made solid in the electrically conductive element, the resistance temperature coefficient of the heating resistor may be changed, not defining any special limitation. For this adjusting element, as shown in the second or third invention, such a metallic element may be taken up which is at least one kind of W, Ta, Nb, Ti, Mo, Zr, Hf, V and Cr, and is different from the metallic elements contained in the electrically conductive element. Among these metallic elements, V, Cr, Nb and Ta are desirous.

When the total of the electrically conductive element and the adjusting element is 100 wt % (in this case, called merely as "%", preferably 0.2 to 5% and more preferably 0.2 to 4.5%). If the adjusting element is contained less than 0.1%, the sintering property of materials of the resistor is severely irregular when baking, easily causing insufficient sintering or reversely growth of oversized grains so that properties of strength and electric conductance durability are decreased, and if the adjusting element is contained more than 5.0%, the lowering of heat resistance or the increasing thermal expansion of the heating resistor are brought about so that the electric conductive durability is undesirably lowered.

The ceramic element contained in the heating resistor or the ceramic element for composing the base may be selected in view of purposes, for example, the silicon nitride quality, alumina or aluminum nitride may be selected. In them, the silicon nitride quality is preferable. In this silicon nitride quality, elements containing mainly silicon nitride are broadly included, and the main element is not limited to silicon nitride. In general, since sintering assistants (oxides of Y, Yb or Er) are mixed several wt % (around 2 to 10 wt %) in the heating resistor and baked, elements resulted from these assistants (compounds) are contained in the heating resistor.

When the average grain diameter of the conductive element is 11 μm or less, it is possible that the anti-bending strength is 1250 MPa or more (preferably 1300 MPa or more) and/or the cycle number (called as "durability" hereinafter) that no breaking of wire is caused by an electric supply per minute at 1400° C. is 10,000 cycles or more.

Further, when the electrically conductive clement is WC and the containing rate of the adjusting element is changed until 0.1 to 5%, and when the average grain diameter is 11 μm or less, the resistance temperature coefficient of the heating resistor may be changed until 2.8 to 3.9. In this case, it is also possible that the anti-bending strength is 1250 MPa or more and the durability is 10,000 cycles or more.

The method of manufacturing the ceramic heater according to this embodiment includes the steps of preparing mixed powders of raw materials for an electrically conductive element and raw materials for an adjusting element to be made at least parts solid as the adjusting element for changing resistance temperature coefficient after baking, producing a molded body shaped in an heating resistor from the mixed powders, buying thereafter the molded body in raw materials for the base composed of the ceramic powders to be one body, and baking it, wherein the raw materials for the electrically conductive element are at least one of a carbide, nitride and silicide of one or more metallic elements selected from W, Ta, Nb, Ti, Mo, Zr, Hf, V and Cr, and when the total of the electrically conductive element and the adjusting element is 100 wt %, the adjusting element is 0.1 to 5.0 wt %, and average diameter of crystal grains of the electrically conductive element comprising the heating resistor obtained by baking is 11 μm or less.

The raw material for the electrically conductive element contains as shown above one or more of a silicide, carbide and nitride or W and other elements, and may contain these composite compounds. Among them, the compounds of W, Ti, Mo, Zr and Hf are preferable, and in particular, WC powders, TiN powders or $MoSi_2$ powders are preferable. Further, as shown in the explanation of the electrically conductive element, the more preferable, the nearer is the coefficient of expansion to other ceramic elements (silicon nitride quality), and the better the higher their melting points.

In addition, the grain diameter of the raw materials for the electrically conductive element is enough with 11 μm or less in crystal grain diameter of the electrically conductive element in the sintered body after baking, for example, the grain diameter may be 1.8 μm or less (especially, 0.5 μm or more), preferably 0.5 to 1.5 μm, more preferably 0.5 to 1.2 μm. Particularly, by making the grain diameter 1.8 μm or less (especially 0.5 μm or more), the crystal grain diameter of the conductive element can be 11 μm or less, and by making the grain diameter 1.5 μm or less (especially, 0.5 μm or more), the crystal grain diameter thereof can be 10 μm or less (especially 0.5 μm or more), and by making the grain diameter 1.2 μm or less (especially 0.5 μm or more), the crystal grain diameter can be 5 m or less (especially 4 μm or less)

The raw material for the adjusting element is to adjusting the resistance temperature coefficient in the heating resistor for the ceramic after sintering, and is sufficient with such substances which do not largely decrease the strength and the durability by mixing 0.5% or more. The raw material, as shown in the fifth invention, is at least one of W, Ta, Nb, Ti, Mo, Zr, Hf, V and Cr, and may be at least one of a carbide, oxide, nitride and silicide or metallic elements different from the metallic element contained in the electrically conductive element. Among them, carbide, oxide, nitride and/or silicide of V, Cr, Nb, Ta, Zr, and Ti are preferable, and particularly carbide, oxide and/or nitride of V, Cr and Nb are preferable. Actually, there may be used (1) VC, $V_2O_5$, VN, (2) $Cr_3C_2$, $Cr_2O_3$, CrN, $Cr_3Si_2$, (e) NbN, NbC, (4) $MoSi_2$, $Mo_5Si_3$, (5) ZrC, ZrN, (6) TaC, TaN, (7) WC, $W_2C$, (8) TiC, TiN. However, the materials containing metallic elements composing the heating resistor are excepted. For example, boride ($W_2B_5$, $TiB_2$, MoB, $Mo_2B$, $MoB_2$, or CrB) may be selected.

The mixing rate of the raw material for the adjusting element is, as shown in the explanation of the adjusting element, 0.5 to 5.0% (preferably 0.2 to 5.0%, more preferably 0.2 to 4.5%). If the adjusting element is contained less than 0.1%, the sintering property of materials of the resistor is severely irregular when baking, easily causing insufficient sintering or reversely growth of oversized grains so that properties of strength and electric conductive durability are decreased, and if the adjusting element is contained more than 5.0%, the lowering of heat resistance or the increasing thermal expansion of the heating resistor are brought about so that the electric conductance durability is undesirably lowered.

Kinds of the ceramic powdered materials buried therein with desired molded bodies or the raw materials for the base may be selected in view of purposes, and ordinarily ceramic powdered materials of silicon nitride elements are employed. The silicon nitride quality is meant as mentioned, and the sintering assistant is appropriately used as said.

Shapes of these raw materials are not specially limited and may be merely powdered, granulated or pulverized, and grain diameters are not specially limited.

In the heating resistor for ceramic heaters, parts of all of the adjusting element are made solid in crystal grains of the conductive element are made solid in crystal grains of the conductive element. When the raw materials for the adjusting element are much mixed and baked, the among of the adjusting element contained in the ceramic heaters and accordingly the amount of the adjusting element made solid are increased. Following this increase, the resistance temperature coefficients are small (see Table 2). Thus, if the adjusting element is contained in the electrically conductive element at an optional rate, the resistance temperature coefficient of the heating resistor can be optionally determined.

The adjusting element is not only made solid in the crystal grains of the conductive element, but also partially segregated as various compounds in grain boundary phases. It is assumed that the adjusting element segregated in the grain boundary gives influences to changes of the resistance temperature coefficient of the heating element, but large influences to an extent of being made solid will not be generated.

By making at predetermined size or less the average grain diameter of the conductive element composing the heating resistor as the sintered body, the anti-bending strength and the durability can be made excellent, and the resistance temperature coefficient can be also adjusted.

As the adjusting element can bring about large effects at a small amount of addition, the addition of the adjusting element gives little bad influences to properties other than the resistance temperature coefficient of the heating resistor (for example, strength, durability, thermal shock resistance and adherence).

Reference will be made in detail to the inventive ceramic heater and the method of manufacturing the same of the second embodiment.

(1) Production of the Ceramic Heaters

A mixture is WC powders as the raw materials for the conductive element, the raw materials for the adjusting element of a predetermined amount (VC, $Cr_2O_3$ and $Nb_2O_5$ powders, see Table 2), the ceramic powders for insulation ($Si_3N_4$ powders) 34 wt %-called after merely as "%") and the sintering assistant ($Yb_2O_3$ or $Er_2O_3$) 6%. In this case, the total amount of WC powders and the raw material for the adjusting element of the predetermined amount is 60%. They were wet-mixed for 72 hours. Subsequently, the mixed powders were produced by drying, thrown together with a binder into a kneading machine and mixed for 4 hours. Then, the kneaded matter was cut into pellets, and thrown into an injection molding machine to turn out U-shaped unsintered heater body provided at both sides with tungsten-made lead wires.

60 minutes to turn out ceramic heaters. The grain diameter of the conductive element was adjusted by changing the grain diameter of the raw materials for the conductive element (WC powders in the present example). In Tables 2, the average grain diameters of each used WC powders are 0.6 μm in the cases of (1) Nos. 1 to 8, 17, 19, 20, 23; 1.0 μm in the cases of (2) Nos. 9 to 16, 18, 21, 22 and 24; 1.5 μm in the cases of (3) Nos. 25 and 26; and 2.0 μm in the cases of Nos. 27 and 28.

(2) Composition of the Ceramic Heaters

The ceramic heater as shown in FIGS. 1 and 2 were manufactured in the manner as described above. The structure of the ceramic heater is similar to that of the first embodiment. Accordingly, the description thereof is omitted here.

(3) Evaluation of the Ceramic Heater

With respect to the ceramic heaters produced as above, tests were made on the anti-bending strength, resistance temperature coefficient and durability of the heating resistors (the heating parts), and results are shown in Table 2.

The anti-bending strength was obtained by a three point bending test (span; 20 mm and cross head speed; 0.5 mm/sec). The resistance temperature coefficients are ratios

TABLE 2

| No. | Average grain diameter (μm) of Conductive Element | Contents (wt %) of Adjusting Element V | Cr | Nb | Total | Anti-Bending Strength (MPa) | Resistance Temperature Coefficient R1000° C./R25° C. | Conductive Durability Test of 1400° C./Min ON-OFF |
|---|---|---|---|---|---|---|---|---|
| 1 | 1.5 | 0.0 | 0.3 | 0.0 | 0.3 | 1320 | 3.5 | 10000 cycles OK |
| 2 | 1.5 | 0.0 | 1.0 | 0.0 | 1.0 | 1340 | 3.4 | 10000 cycles OK |
| 3 | 1.6 | 0.0 | 3.2 | 0.0 | 3.2 | 1320 | 3.0 | 10000 cycles OK |
| 4 | 1.4 | 0.0 | 4.3 | 0.0 | 4.3 | 1340 | 2.9 | 10000 cycles OK |
| 5 | 1.5 | 0.2 | 0.0 | 0.0 | 0.2 | 1300 | 3.5 | 10000 cycles OK |
| 6 | 1.6 | 0.2 | 0.6 | 0.0 | 0.8 | 1340 | 3.4 | 10000 cycles OK |
| 7 | 1.5 | 0.9 | 2.1 | 0.0 | 3.0 | 1320 | 3.1 | 10000 cycles OK |
| 8 | 1.3 | 0.8 | 2.0 | 0.5 | 3.3 | 1300 | 3.0 | 10000 cycles OK |
| 9 | 3.6 | 0.0 | 0.3 | 0.0 | 0.3 | 1310 | 3.7 | 10000 cycles OK |
| 10 | 3.5 | 0.0 | 0.9 | 0.0 | 0.9 | 1310 | 3.6 | 10000 cycles OK |
| 11 | 3.6 | 0.0 | 3.4 | 0.0 | 3.4 | 1290 | 3.2 | 10000 cycles OK |
| 12 | 3.6 | 0.0 | 4.3 | 0.0 | 4.3 | 1300 | 3.1 | 10000 cycles OK |
| 13 | 3.7 | 0.2 | 0.0 | 0.0 | 0.2 | 1290 | 3.7 | 10000 cycles OK |
| 14 | 3.8 | 0.2 | 0.7 | 0.0 | 0.9 | 1330 | 3.6 | 10000 cycles OK |
| 15 | 3.6 | 0.9 | 2.1 | 0.0 | 3.0 | 1300 | 3.3 | 10000 cycles OK |
| 16 | 3.6 | 0.8 | 2.2 | 0.5 | 3.5 | 1320 | 3.2 | 10000 cycles OK |
| 17 | 1.4 | 0.0 | 0.0 | 0.0 | 0.0 | 1180 | 3.5 | 1500 cycles broken |
| 18 | 3.6 | 0.0 | 0.0 | 0.0 | 0.0 | 1170 | 3.7 | 1200 cycles broken |
| 19 | 1.5 | 0.0 | 6.2 | 0.0 | 6.2 | 1300 | 2.6 | 2200 cycles broken |
| 20 | 1.4 | 1.0 | 5.8 | 1.2 | 8.0 | 1320 | 2.3 | 1700 cycles broken |
| 21 | 3.4 | 0.0 | 7.0 | 0.0 | 7.0 | 1290 | 2.7 | 1500 cycles broken |
| 22 | 3.6 | 1.2 | 5.1 | 0.9 | 7.2 | 1310 | 2.7 | 1000 cycles broken |
| 23 | 1.5 | 0.2 | 0.6 | — | 0.8 | 1340 | 3.4 | 10000 cycles OK |
| 24 | 3.6 | 0.2 | 0.7 | — | 0.9 | 1330 | 3.6 | 10000 cycles OK |
| 25 | 7.2 | 0.2 | 0.6 | — | 0.8 | 1310 | 3.7 | 10000 cycles OK |
| 26 | 9.4 | 0.2 | 0.6 | — | 0.8 | 1300 | 3.8 | 10000 cycles OK |
| 27 | 12.5 | 0.2 | 0.7 | — | 0.9 | 1210 | 3.9 | 1,200 cycles broken |
| 28 | 15.4 | 0.2 | 0.6 | — | 0.8 | 1080 | 4.1 | 800 cycles broken |

On the other hand, the sintering assistant powders (about 6%) ($RE_2O_3$ (RE: Er, Yb, Dy, Y, etc.))was mixed into $Si_3N_4$ powders, mixed for 40 hours, granulated by a spray dryer method, buried therein to with the unsintered heater body during this granulation, and pressed all over them to turn out unsintered ceramic heaters. Then, the unsintered ceramic heater was temporarily baked at 600° C. for about 2 hours to remove the binder and produce a temporarily baked body. The temporarily baked body was set in a hot pressing carbon mold, and hot-press-baked at 1800° C., 300 kgf/cm$^2$ and for of the resistant values of the respective heating resistors at temperatures of 1000° C. and 25° C. The tests of the conductive durability were carried out by impressing voltage that a saturation temperature (saturated for about 20 seconds) in a portion having highest temperature by electric conduction is 1400° C., determining 1 cycle by stopping impression and leaving for one minute, and measuring the cycle number until breaking wires. The crystal grain diameters of the conductive element were obtained by photographs of an electron microscope.

According to the results of Table 2, in the comparative examples without containing the adjusting element (Nos. 17 and 18), the strength is small as 1180 MPa and 1170 MPa, and in the durability, wires were respectively broken at 1500 cycles and 1200. In cases that the adjusting elements were much as 6.2 to 8.0% (Nos. 19 to 22), the anti-bending strength was good but in the durability the wires were broken at 1000 to 2200 cycles.

On the other hand, in the examples (Nos. 1 to 16) where the grain diameters of the adjusting element were 1.4 to 3.8 μm and the contents thereof were 0.2 to 4.3 %, the anti-bending strength was large as 1290 to 1340 MPa, and in the durability, no breaking of wire occurred at 10000 cycles, exhibiting very excellent durability. When the conductive element was WC, the resistance temperature coefficient could be appropriately adjusted within the range of 3.7 to 2.9 following the contents of the adjusting elements (0.2 to 4.3%).

According to the examples (Nos. 23 to 28) where effects by sizes of crystal diameter of the adjusting element were investigated, in the comparative examples of the average grain diameter being 12.5 and 15.4 μm (Nos. 27 and 28), the anti-bending strength was small as 1210 and 1080 MPa, and in the durability, breaking of wires occurred at 1200 and 800 cycles, showing considerably bad durability.

In contrast, in the examples of the grain diameter for the adjusting elements being 1.5 to 9.4 μm (Nos. 23 to 26), the anti-bending strength was slightly lower following the order but large as 1300 to 1340 MPa, and in the durability no breaking of wires occurred at 10000 cycles, exhibiting excellent durability. In these cases (Nos. 23 to 27), the amounts of the adjusting elements were little different (0.8% or 0.9%), so that the resistance temperature coefficients were almost the same.

Not limiting to the examples, the elements can be varied within the inventive ranges in response to purposes or uses. That is, as the electrically conductive element (raw materials for the electrically conductive element) and the adjusting clement (raw materials for the adjusting element), not only the metallic elements shown in Table 2 (compounds of the metallic elements) but also other metallic elements (compounds of the metallic elements) may be used. Further, as the raw materials for the adjusting element, a metallic simple substance can be used other than the ceramic compounds of carbides.

The molding method of the heating resistor may depend upon arbitrary methods as a thick film printing, not limiting to the injection molding.

Also, in this embodiment, a double frame ceramic heater 2A as shown in FIG. 3 can be manufactured.

According to the heating resistor for the ceramic heater or the ceramic heater according to the second embodiment, while maintaining the excellent anti-bending strength and conductive durability, the heating resistor or the ceramic heater of the desired heating properties may be produced by changing the resistance temperature coefficient. By making at the predetermined size or less the average grain diameter of the conductive element composing the heating resistor as the sintered body, the anti-bending strength and the durability can be made considerably excellent.

According to the method of manufacturing the ceramic heater according to the second embodiment, the useful ceramic heater can be made easily and securely.

What is claimed is:

1. A heating resistor for a ceramic heater comprising:

an electrically conductive element containing materials including at least one of a silicide, carbide and nitride of at least one metallic element selected from W, Ta, Nb, Ti, Mo, Zr, Hf, V and Cr;

an adjusting element made at least with the materials of the electrically conductive element for changing a resistance temperature coefficient of the heating resistor for the ceramic heater; and a sintered body wherein when a total of the electrically conductive element and the adjusting element is 100 wt %, the adjusting element is 0.1 to 5.0 wt %, and average diameter of crystal grains of the electrically conductive element is 11 μm or less.

2. The heating resistor for a ceramic heater according to claim 1, wherein the adjusting element is a metallic element comprising at least one of W, Ta, Nb, Ti, Mo, Zr, Hf, V and Cr, and is different from the metallic element contained in the electrically conductive element.

3. A ceramic heater comprising:

a ceramic base;

a heating part to be buried in the ceramic base, comprising a heating resistor having an electrically conductive element containing materials including at least one of a silicide, carbide, and nitride of at least one metallic element selected from W, Ta, Nb, Ti, Mo, Zr, Hf, V and Cr; and an adjusting element made at least with the materials of the electrically conductive element for changing a resistance temperature coefficient of the heating resistor for the ceramic heater, wherein the heating resistor comprises a sinter ed body; and when a total of the electrically conductive clement and the adjusting element is 100 wt %, the adjusting clement is 0.1 to 5.0 wt %, and average diameter of crystal grains of the electrically conductive clement is 11 μm or less.

4. The ceramic heater according to claim 3, further comprising a control resistor formed in at least one side of the heating part, the heating part and the control resistor constituting a compound member.

5. The ceramic heater according to claim 3, wherein the adjusting element is a metallic element comprising at least one of W, Ta, Nb, Ti, Mo, Zr, Hf, V and Cr, and is different from the metallic element contained in the electrically conductive element.

6. A method of manufacturing a ceramic heater, comprising the steps of:

mixing raw materials for an electrically conductive element composed of at least one of a silicide, carbide, and nitride of one or more metallic elements selected from W, Ta, Nb, Ti, Mo, Zr, Hf, V, and Cr and raw materials for an adjusting element;

molding the mixture;

burying the molded body in ceramic powdered materials; and baking the molded body buried in the ceramic powdered materials, wherein when a total of the electrically conductive clement and the adjusting element is 100 wt %, the adjusting element is 0.1 to 5.0 wt %, and average diameter of crystal grains of the electrically conductive element is 11 μm or less.

7. The method of manufacturing a ceramic heater according to claim 6, wherein the adjusting element is a metallic element comprising at least one of W, Ta, Nb, Ti, Mo, Zr, Hf, V and Cr, and is different from the metallic element contained in the electrically conductive element.

* * * * *